US005528779A

United States Patent [19]

Lee et al.

[11] Patent Number: 5,528,779

[45] Date of Patent: Jun. 25, 1996

[54] AIR-CUSHIONED SLEEPING BAG

[76] Inventors: Li-Hsen Lee; Lichang Young, both of Taipei, Taiwan

[21] Appl. No.: 329,098

[22] Filed: Oct. 25, 1994

[51] Int. Cl.[6] ..... A47C 29/00

[52] U.S. Cl. ..... 5/413 AM; 5/418; 5/419; 5/420; 5/421; 2/69.5

[58] Field of Search ..... 5/413, 418, 419, 5/420, 421; 2/69.5

[56] References Cited

U.S. PATENT DOCUMENTS

| | | | |
|---|---|---|---|
| 598,995 | 2/1898 | Jacob | 5/413 |
| 622,812 | 4/1899 | Lapierre | 2/69.5 |
| 867,464 | 10/1907 | Abbott | 5/413 |
| 1,648,373 | 11/1927 | Vilas | 5/413 |
| 1,699,002 | 1/1929 | Leibold | 5/413 |
| 3,380,087 | 4/1968 | Petty et al. | 5/413 |
| 4,092,750 | 6/1978 | Ellis | 5/413 |
| 4,192,030 | 3/1980 | Casson | 2/69.5 |
| 4,757,832 | 7/1988 | Russell | 5/413 |
| 4,825,868 | 5/1989 | Susa et al. | 5/421 |
| 5,005,236 | 4/1991 | Hutchinson | 5/413 |

FOREIGN PATENT DOCUMENTS

| | | | |
|---|---|---|---|
| 2481589 | 11/1981 | France | 5/413 |
| 648452 | 1/1951 | United Kingdom | 5/413 |
| 2025764 | 1/1980 | United Kingdom | 5/421 |

*Primary Examiner*—Michael J. Milano
*Attorney, Agent, or Firm*—Beveridge, DeGrandi, Weilacher & Young

[57] ABSTRACT

An air-cushioned sleeping bag comprises a bottom portion and a cover member partially connected on their corresponding edges and partially fastened by zipper on their rest edges. The bottom portion comprises a plurality of the elongate air compartments parallel extended along the longitudinal direction thereof, a transverse inflatable pillow adjacent one end of the compartments and a shading member extended outward from the outward edge of the pillow. A heating member disposed between a mat cloth and the top of the compartments is preserved for applying in extreme cold weather. The air-cushioned sleeping bag of the present invention is applicable to uneven and hard surface without a tent and prevent a traveller from the dampness and coldness of the ground where he lies.

3 Claims, 4 Drawing Sheets

AIR-CUSHIONED SLEEPING BAG

BACKGROUND OF THE INVENTION

The present invention relates to sleeping bags, more particularly to an air-cushioned sleeping bag which has an inflatable device and heating means placed in the bottom portion of the bag in order to shield a sleeper from coldness and dampness of the ground and to provide user utmost comfort and utility. A built-in inflatable pillow incorporated with a shading member over the head of a sleeper provide the user additional orthopedic comfort and facial protection from dew, wind chill and light sources.

Sleeping bags are generally used by campers and hikers for sleeping outdoors. Prior art sleeping bags are mostly in the form of a padded and zippered sleeve. Their padding materials are normally made of cotton, polyesters or down feather and their outer layer is made of cotton, polyester or nylon. So that these bags can be rolled into a roll to be easily carried by users in situation where portability is important. However, prior art sleeping bags are disadvantageous because they cannot effectively shield user from dampness and coldness of the ground, and cannot offer comfortable cushioning effect to offset hardness and unevenness of the sleeping surfaces without adding too much bulk and weight compromising their portability requirements. Furthermore, prior art sleeping bags so not feature built-in adjustable pillow to provide additional comfort to the user and are not equipped with electrical heating elements for warmth in extreme cold weather, and also do not provide overhead canopy shielding user's facial area from dew, wind chill and light sources.

SUMMARY OF THE PRESENT INVENTION

The main object of the present invention is to provide an air-cushioned sleeping bag having plurality of spaced apart inflatable air compartments and heating member placed within the bottom portion thereof for shielding the sleeper from the dampness and coldness of the ground.

Another object of the present invention is to provide an air-cushioned sleeping bag in which the air compartments and the heating member thereof provide comfortable feeling to a sleeper lying on a rocky, uneven or hard sleeping surface.

A further object of the present invention is to provide an air-cushioned sleeping bag having an inflatable pillow on the open end, which can be infinitely adjustable in accommodation with humen body to provide user additional orthopedic comfort.

Still further object of the present invention is to provide an air-cushioned sleeping bag having a flexible shading member over the pillow for protecting the sleeper's facial area from dew, wind chill and light sources.

Accordingly, the air-cushioned sleeping bag of the present invention comprises a rectangular bottom portion and a cover member partially connected at their corresponding edges and partially fastened by a zipper therebetween.

The bottom portion is composed of a inflatable device and a heating member wrapped by the mat cloths therein. The inflatable device is manufactured by joining together a pair of gas impervious rectangular sheets by heat-sealed at their edges to form an envelope and then providing spaced apart longitudinal seams by heat-sealed again to define a plurality of elongate air compartments between the pair of the sheets.

An air passage is formed between each adjacent elongate compartments and an air valve provided at the outward edge of an outmost compartment on one of the lateral sides of the envelope. An infinitely adjustable pillow is formed adjacent one end of the elongate compartments and blocked apart from the compartments. An air valve locates at one of the lateral ends of the pillow. A shading member used as an overhead canopy extends longitudinally from the pillow which is formed by heat-sealed a plurality of transverse seams between the two gas impervious sheets for the reinforcement thereof and a pair of the elongate flexible metals disposed along the lateral sides. The heating member is disposed between a mat cloth and the top surface of the elongate compartments beneath the back of humen body. The cover member is composed of two sheets of the mat cloth filled with down feathers, cotton or polyesters.

The present invention will become more fully understood by reference to the following detailed description thereof when read in accompanying with the attached drawings.

DETAILED DESCRIPTION Of THE PREFERRED EMBODIMENT

Figure 1:
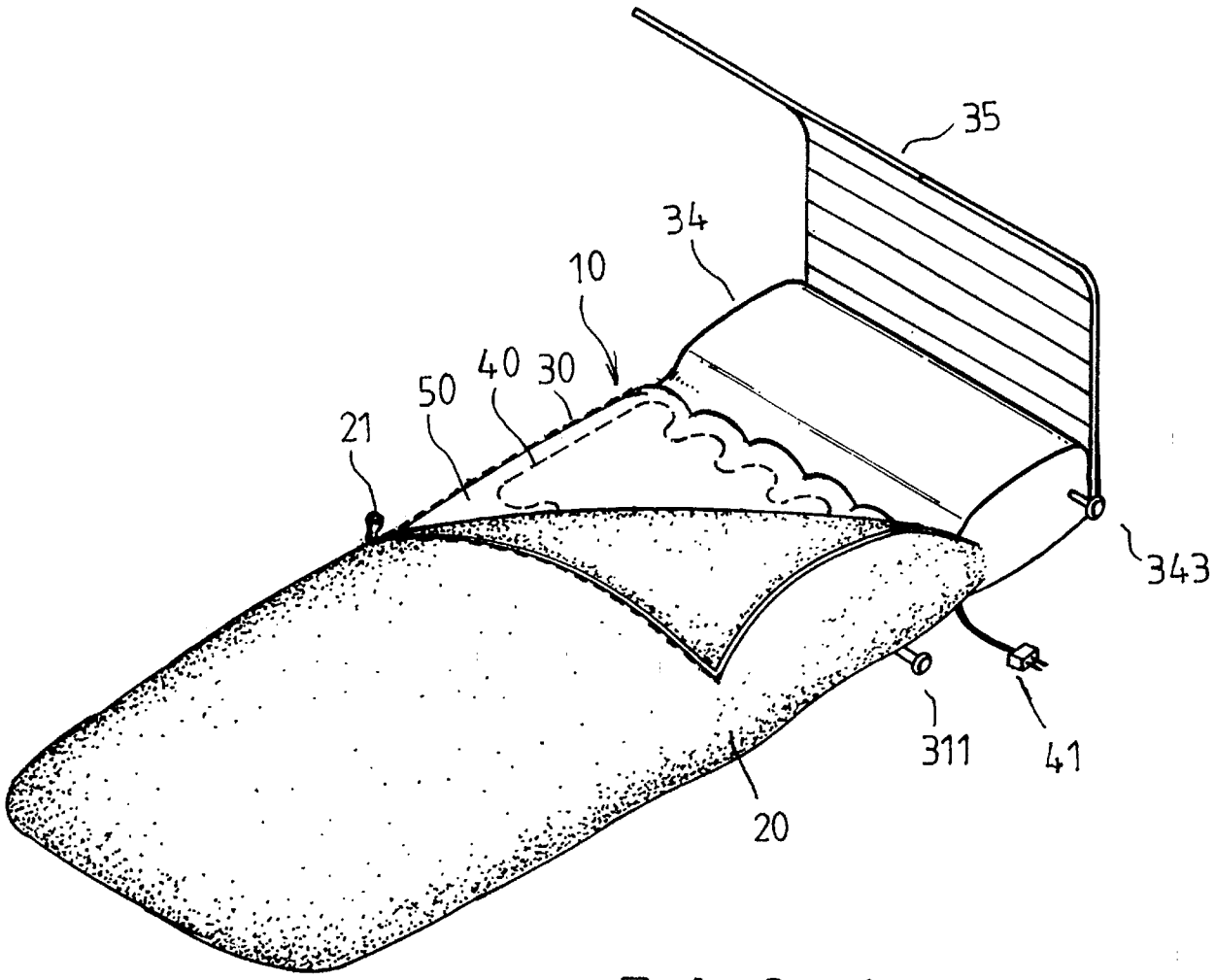
FIG. 1 is a perspective view to show the preferred embodiment of the present invention.
Figure 2:
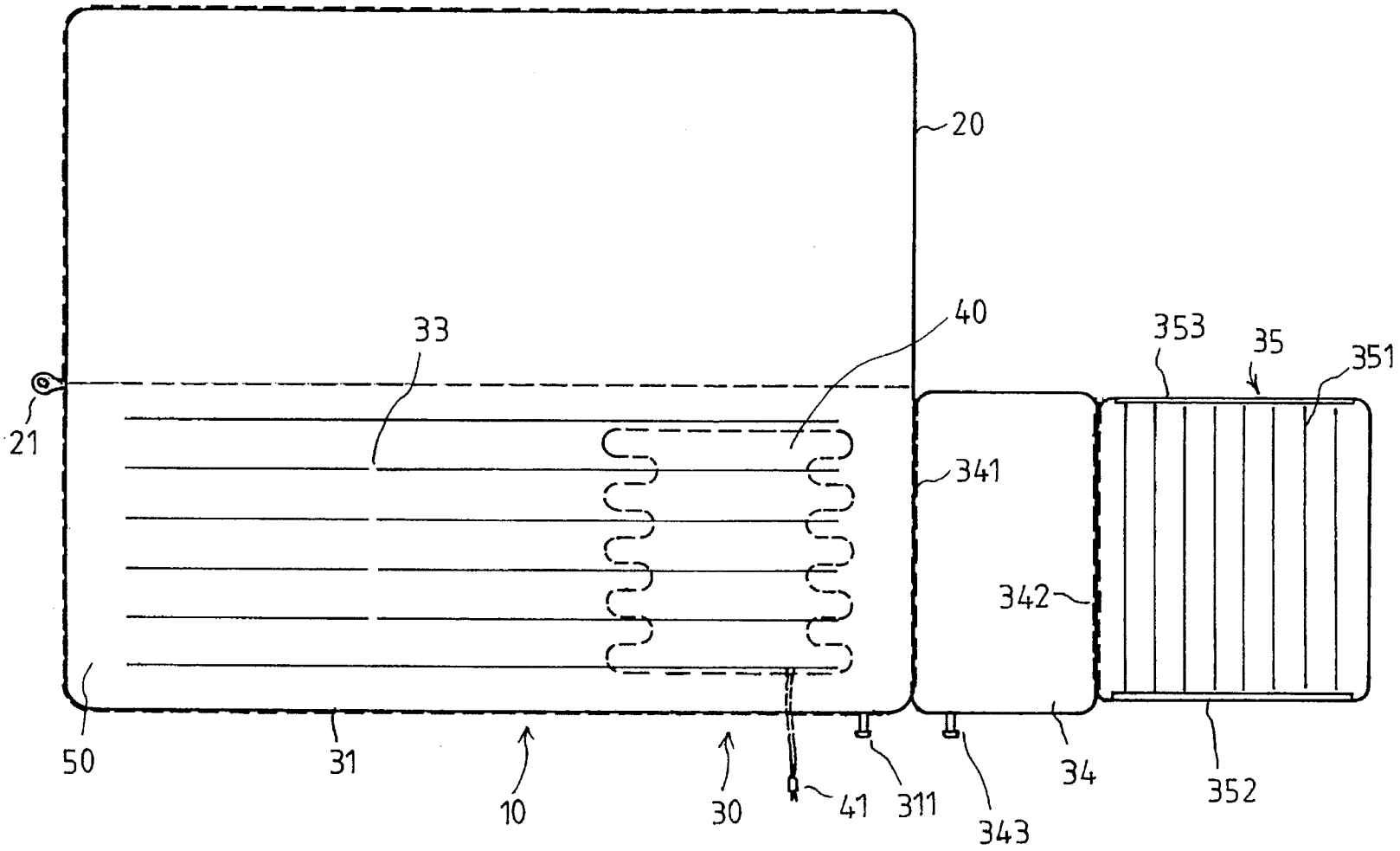
FIG. 2 is a plain view to show a display of the preferred embodiment according to the present invention.

Referring to FIGS. 1 and 2, the air-cushioned sleeping bag of the present invention comprises a rectangular bottom portion 10 and a rectangular cover member 20 partially connected on their corresponding edges and partially fastened on their rest corresponding edges by a zipper 21.

The bottom portion 10 is comprised of a inflatable device 30 and a heating member 40 wrapped by the mat cloths 50 therein. The inflatable device 30 is manufactured by joining together a pair of expansionary gas impervious rectangular sheets (as shown in FIG. 2) by heat-sealed at their corresponding edges to form an envelope at first and then providing spaced apart longitudinal seams by heat-sealed again to define a plurality of parallel and longitudinally extended elongate air compartments 31 between the two sheets. An air valve 311 locates at the outward edge of an outmost air compartment 31 and an air passage 33 formed between each adjacent air compartments 31 thereof for inflating purpose. An infinitely adjustable pillow 34 is independently formed adjacent one end of the elongate air compartments 31 and perpendicular to the compartments. The pillow 34 is defined by heat-sealed a pair of spaced apart transverse seams 341 and 342 across the pair of the gas impervious sheets in predetermined width with an air valve 343 locating at a lateral side thereof. A shading member 35 used as an overhead canopy extends longitudinally from the outward edge of the pillow 34 including a plurality of heat-sealed seams parallel and transversally extended across the gas impervious sheets and a pair of flexible elongate metals 352 and 353 disposed along the lateral sides respectively, which can be readily bent or straightened and used to support the shading member 35 when uprising.

The heating member 40 which is of the type similar to those applied to bed clothes occupies about one third area of the bottom portion 10 where directs to the back of a sleeper. An electrical plug or adaptor 41 connecting the heating member 40 protrudes out from one side of the bottom portion 10, which is preserved to electrically connect to a battery (not shown) in extreme cold weather.

Figure 3:
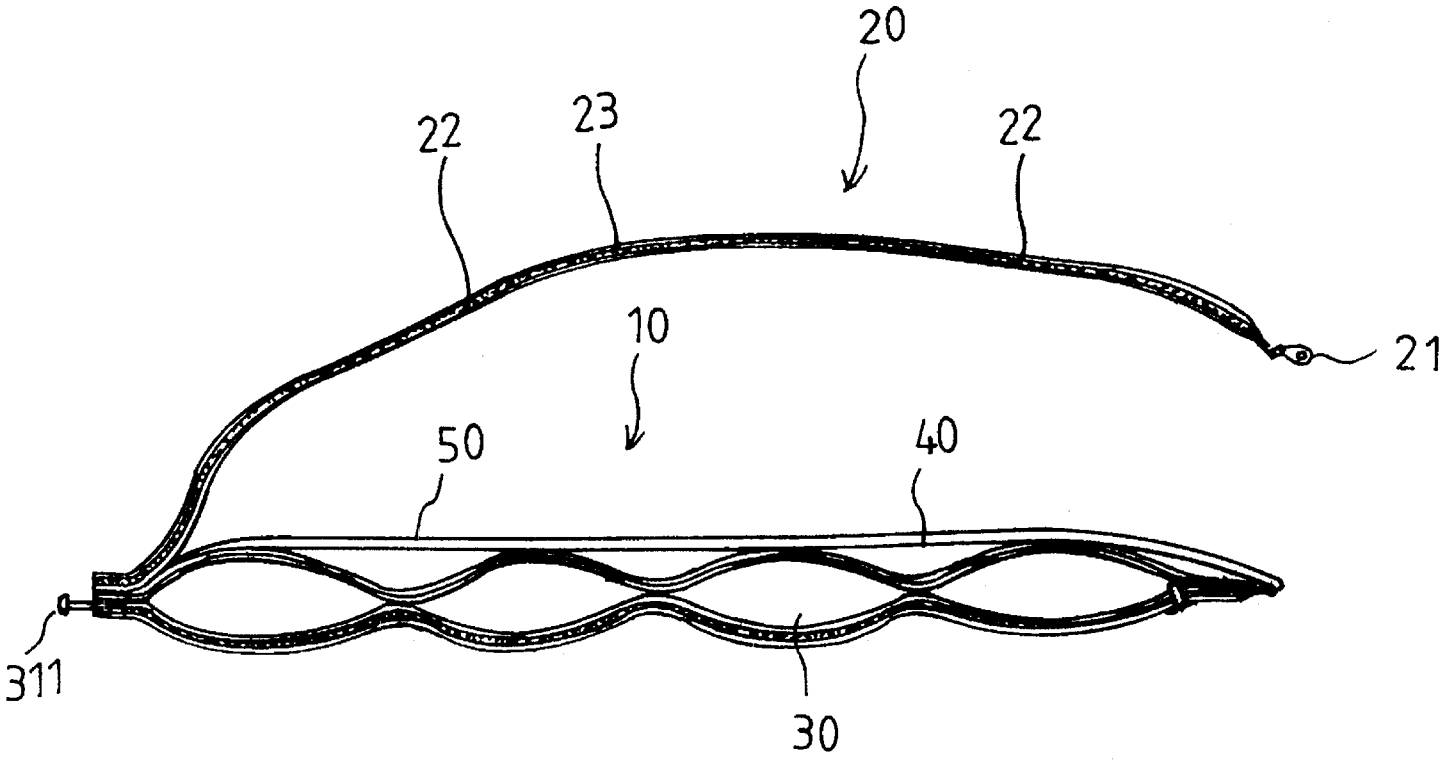
FIG. 3 is a cross-sectional view to illustrate the inflated elongate compartments and the cover member of the present invention.

Referring to FIG. 3, the cover member 20 is composed of two layers of the mat cloths, nylon or the like 22 filled with cotton or down feather 23 and a zipper sewn along the rest edge of the cover member 20 for fastening purpose.

Figure 4:
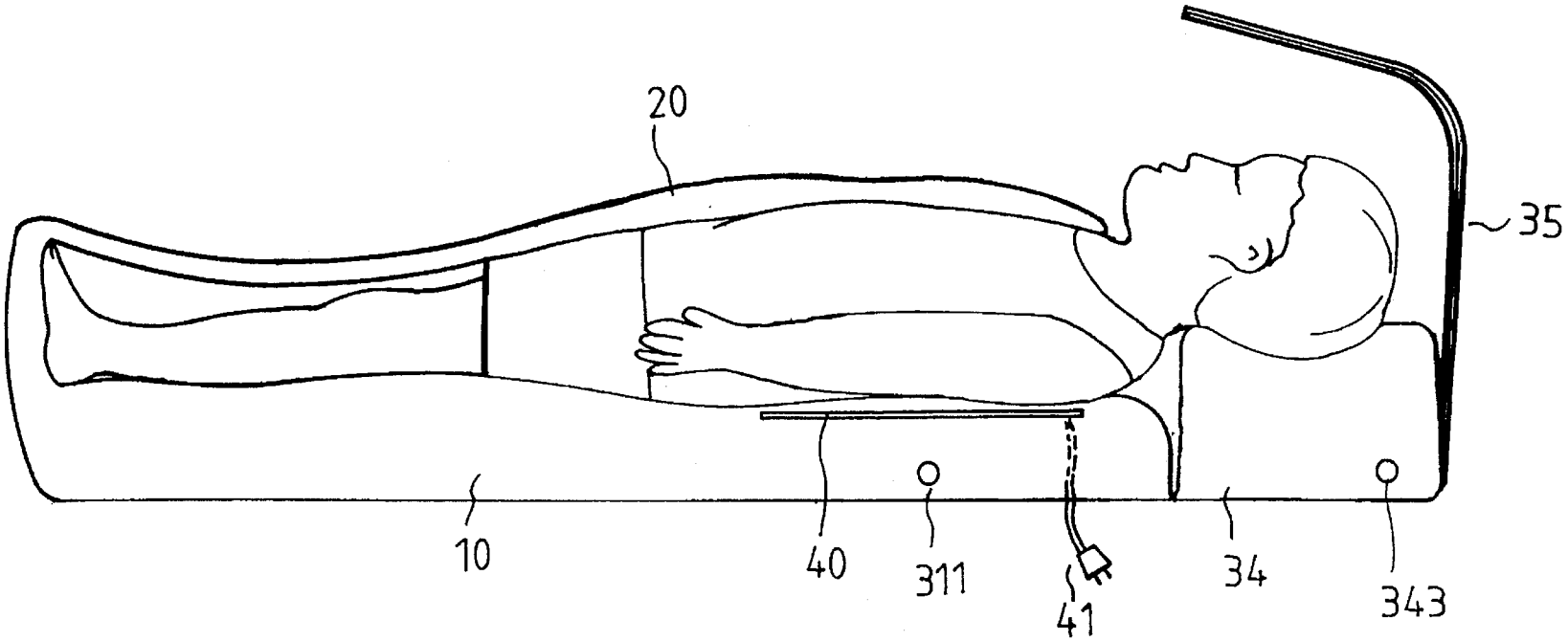
FIG. 4 is a side view to illustrate the air-cushioned sleeping bag of the present invention being applied by a sleeper.

The inflatable sleeping bag of the present invention is foldable normally and can be carried in a roll within a knapsack (not shown). When applying, display it on the ground at first and inflate the elongate air compartments 31 as well as the pillow 34 via the air valves 311 and 343 manually or by a mini air compressor so as to expand the air compartments and the pillow to a predetermined volume, then lie down into the bag and fasten the zipper 21 on left side before getting into sleeping. The shading member 35 can be uprised by two hands if sleeps without a tent (as shown in FIG. 4). Each of the two air valves 311 and 343 has an attached cover which covers to prevent the gas from leaking out of the inflatable device 30. But the gas is readily to deflate when opens the cover and applies slightly the pressure on the inflatable device 30.

With the invention thus explained, it is apparent that obvious modifications and variations can be made without departing from the scope of the invention. It is therefore intended that the invention be limited only as indicated in the appended claims and their legal equivalents.

We claim:

1. An air-cushioned sleeping bag comprising a rectangular bottom portion and a rectangular cover member partially connected on their corresponding edges and partially fastened by a zipper on their rest edges;

said bottom portion composed of two layers of mat cloths with an inflatable device and a heating member wrapped therein;

said inflatable device comprising a plurality of spaced apart elongate air compartments parallel extended along a longitudinal direction having an air passage between said each adjacent air compartments and an air valve protruded from the outward side of an outmost air compartment, an inflatable pillow transversally formed adjacent one end of said air compartments having an air valve protruded from one end thereof and a shading member extended from an outward edge of said inflatable pillow, said heating member disposed between one of said mat cloths and the top surface of said elongate air compartments, occupying about one third area of said air compartments where directs to the back of a sleeper, and an electrical contact means protruded from said bottom portion, said cover member comprising two layers of mat cloths filled with cotton or down feather therein and having said zipper sewed along the rest edges thereof, whereby, said elongate air compartments and said pillow of said bottom portion are inflatable when applying and deflatable when folding; said shading member is flexible to form an overhead canopy over the facial area of a sleeper when sleeping.

2. An air-cushioned sleeping bag according to claim 1, wherein said shading member comprises a plurality of reinforcing transverse seams parallel extended across said mat cloths and a pair of flexible elongate metals disposed along the length of the lateral sides thereof.

3. An air-cushioned sleeping bag according to claim 1, wherein said each air valve has a cover which covers to prevent the gas from leaking out of said inflatable device and opens to deflate the gas out therefrom.

* * * * *